US009239566B2

(12) United States Patent
Koido

(10) Patent No.: US 9,239,566 B2
(45) Date of Patent: Jan. 19, 2016

(54) IMAGE FORMATION UNIT AND IMAGE FORMATION APPARATUS

(71) Applicant: Oki Data Corporation, Tokyo (JP)

(72) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/607,184

(22) Filed: Jan. 28, 2015

(65) Prior Publication Data

US 2015/0212481 A1 Jul. 30, 2015

(30) Foreign Application Priority Data

Jan. 29, 2014 (JP) ..... 2014-014183

(51) Int. Cl.
*G03G 21/16* (2006.01)
*G03G 21/18* (2006.01)

(52) U.S. Cl.
CPC ..... *G03G 21/1814* (2013.01); *G03G 21/1842* (2013.01); *G03G 2221/1884* (2013.01)

(58) Field of Classification Search
CPC ..... G03G 21/1814; G03G 21/1842; G03G 221/1884
USPC ..... 399/111, 118
See application file for complete search history.

(56) References Cited

FOREIGN PATENT DOCUMENTS

JP 59031988 A * 2/1984 ..... G03G 21/00
JP 2012-027253 A 2/2012

* cited by examiner

*Primary Examiner* — Billy Lactaoen
(74) *Attorney, Agent, or Firm* — Marvin A. Motsenbocker; Mots Law, PLLC

(57) ABSTRACT

A housing for an electrostatic latent image carrier is formed with a groove in which a light emitting section of the exposure device is positioned at the usage position. The groove extends in an insertion direction of the light emitting section of the exposure device to the groove. A flexible light-shielding member includes one side fixed to a peripheral part of the groove. The light-shielding member covers the groove when the exposure device is detached from the housing. When the exposure device is attached to the housing, the light-shielding member is bent by the exposure device into the groove. A guide is provided at the upstream end portion of the light-shielding member in the insertion direction. The guide guides the light-shielding member from the closing state to the bent state upon inserting the light emitting section of the exposure device into the groove.

19 Claims, 10 Drawing Sheets

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2014-014183 filed on Jan. 29, 2014, entitled "IMAGE FORMATION UNIT AND IMAGE FORMATION APPARATUS", the entire contents of which are incorporated herein by reference.

BACKGROUND OF THE INVENTION

1. Field of the Invention

The disclosure relates to an image formation unit and an image formation apparatus, and is suitably applied, for example, to an electro-photographic printer (hereinafter may also be referred to as a printer).

2. Description of Related Art

A conventional printer includes: a photosensitive drum; and an exposure device such as a light emitting diode (LED) head having a lens array and light emitting elements such as LEDs. This type of printer forms an electrostatic latent image on a surface of the photosensitive drum by irradiating the surface of the photosensitive drum with light from the exposure device, and develops a toner image by adhering toner to the electrostatic latent image.

For example, this type of printer includes an exposure device attached to a printer housing, and an image formation unit that contains modularized consumables such as a photosensitive drum and various rollers, and is detachably attached to the printer housing. The printer is thus configured to improve efficiency for work such as maintenance. The image formation unit has, for example, a groove through which an end of the exposure device is inserted and positioned in proximity to the photosensitive drum. The groove has a bottom having an exposure opening that allows light from the exposure device to pass therethrough. In addition, a flexible light-shielding film is provided to close the groove.

In the state where the image formation is detached from the printer housing, the light-shielding film closes the grove section thereby preventing the photosensitive drum from being unnecessarily exposed. On the other hand, in the state where the image formation unit is attached to the printer housing, the light-shielding film is deformed by the exposure device to open the groove, thereby causing a light emitting section of the exposure device and the photosensitive drum to face each other (for example, see Japanese Patent Application Laid-Open No. 2012-27253 (FIGS. 1 and 2)).

SUMMARY OF THE INVENTION

The conventional printer has a cover provided on the printer housing, and the exposure device is attached to the lower surface of the cover. The cover can be opened when moved upward, and closed when moved downward. In the conventional printer, when the cover is closed, the exposure device comes closer to the image formation unit from above, and then pushes down the upper surface of the light-shielding film. As a result, the film is bent so that the groove is opened. Therefore, in the conventional printer, no excessive force is applied to the light-shielding film, and therefore the light-shielding film is unlikely to have trouble such as damage and peeling.

Meanwhile, in order to improve workability of maintenance and the like, there is a demand, for example, that the printer be configured such that a left or right side surface of the printer housing can be opened and closed so that the image formation unit can be attached to and detached from the printer housing from the left or right.

However, in such a configuration, the exposure device applies a force to the light-shielding film from a direction parallel to the upper surface of the light-shielding film, when the image formation unit is being attached to the printer housing. Thus, irreversible deformation of the light-shielding film may occur, such as breakage, peeling off, or the like. If the light-shielding film is irreversibly deformed, the light-shielding film may be unable to close the groove even when the image formation unit is detached from the printer housing, leading to unnecessary exposure of the photosensitive drum, which is likely to lower the printer performance.

An object of an embodiment of the invention is to prevent degradation in the print quality.

An aspect of the invention is an image formation unit that includes: an electrostatic latent image carrier configured to carry an electrostatic latent image thereon to be formed by exposure light from an exposure device provided in an image formation apparatus main body; a housing containing the electrostatic latent image carrier therein, and configured to detachably attached to the image formation apparatus main body in an attachment/detachment direction along a main scanning direction of the exposure device; a groove formed at the housing to extend in the attachment/detachment direction, and configured such that, in a state of the housing being attached to the image formation apparatus main body, a light emitting section of the exposure device is positioned in the groove to proximately face the electrostatic latent image carrier through an exposure opening formed at the groove such that the exposure light from the exposure device passes through the exposure opening; a light-shielding member with flexibility, including a first side extending substantially in the main scanning direction and a second side opposite the first side, wherein the first side is fixed to a fixing surface which is a peripheral part of the groove in the housing, such that, in a state of the housing being detached from the image formation apparatus main body, the light-shielding member is in a closing state of closing the groove, and in a state of the housing being attached to the image formation apparatus main body, the light-shielding member is in a retracted state of being bent by the exposure device to position the second side in the groove; and a guide provided at a colliding end portion of the light-shielding member, which first abuts the exposure device when the housing is being attached to the image formation apparatus main body, and the guide being configured to guide the light-shielding member from the closing state to the retracted state when the housing is attached to the image formation apparatus main body.

According to this aspect of the invention, when the image formation unit is attached to the image formation apparatus main body, the exposure device first abuts the guide which then guides the second side of the light-shielding member to come closer to the bottom of the groove. As a result, the light-shielding member can be easily bent to be in the retracted state in which the second side is positioned in the groove, without having trouble such as damage to, and peeling off of, the light-shielding member.

Further, according to the aspect of the invention, when the image formation unit is detached from the image formation apparatus main body, the bending light-shielding member returns to the original shape to reliably close the groove. Therefore, the unnecessary exposure of the electrostatic latent image carrier can be prevented.

Accordingly, the aspect of the invention can prevent degradation in print quality.

DETAILED DESCRIPTION OF EMBODIMENTS

Figure 1:
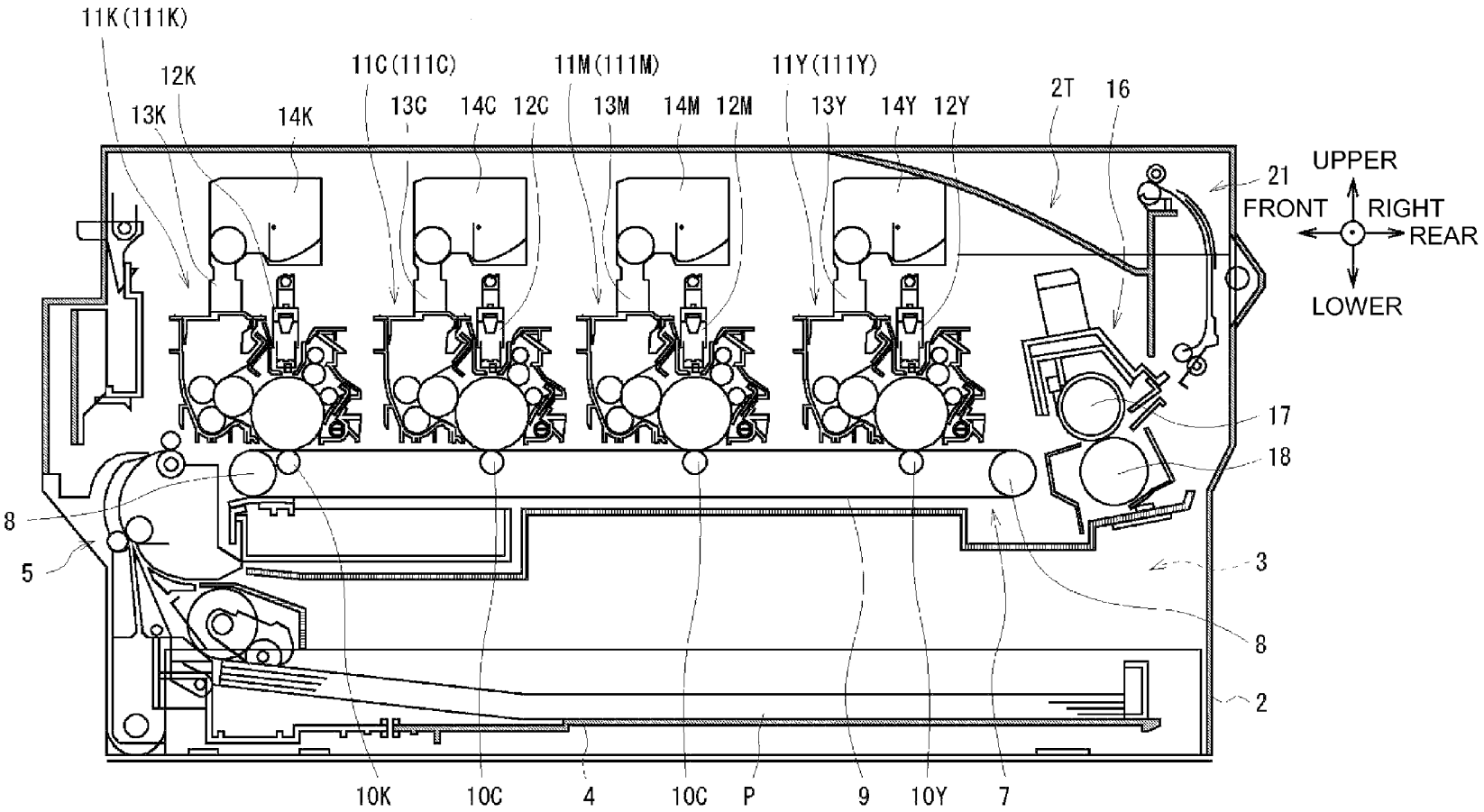
FIG. 1 is a schematic diagram illustrating an internal configuration of a color printer.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of the invention are described below with reference to the drawings.

1. First Embodiment

1-1. Configuration of Color Printer

FIG. 1 is a left-side view of color printer 1 according to the first embodiment. Color printer 1 is an electro-photographic color printer, and prints desired color images on sheets P of different sizes such as A3 and A4.

Color printer 1 serving as an image formation apparatus has printer housing 2 that is substantially shaped like a box. Various components are arranged in printer housing 2. In the following description, a right-end part in FIG. 1 is a front of color printer 1, and a vertical direction, a left-right direction, and a front-back direction are each defined relative to this front. Further, a left-side surface of printer housing 2 has a door (not illustrated) that can be opened and closed to open and close an inner space of printer housing 2.

Controller 3 controls the entire color printer 1. This controller 3 is connected to a host apparatus (not illustrated) such as a personal computer with wire or wirelessly, via a communication processor (not illustrated). Controller 3 performs print processing for forming a print image on a surface of sheet P, upon receiving image data representing a color image to be printed and an instruction for printing the color image, from the host apparatus.

Printer housing 2 includes sheet-feed cassette 4 and sheet feeder 5 that are provided at a lowermost part of printer housing 2. Sheet-feed cassette 4 contains sheets P. Sheet feeder 5 feeds sheets P contained in sheet-feed cassette 4, by separating sheets P one by one. Sheet feeder 5 is disposed above a front end of sheet-feed cassette 4. Sheet feeder 5 includes a combination of components such as rollers each having a central axis extending in the left-right direction, and a guide for guiding sheet P. Based on a control by controller 3, sheet feeder 5 rotates the rollers, thereby extracting sheets P one by one from sheet-feed cassette 4 by separating sheets P, and then moving sheet P upward. Sheet feeder 5 then causes sheet P to turn back at a substantially central position in the vertical direction, in a part in proximity to a front end in printer housing 2.

Transfer belt unit 7 is provided above sheet-feed cassette 4 in printer housing 2. Transfer belt unit 7 is provided to extend in printer housing 2 in the front-back direction, over a long distance. Transfer belt unit 7 includes rollers 8 and transfer belt 9. Roller 8 is shaped like a slim cylinder having a central axis extending in the left-right direction. Roller 8 is disposed at each of the front and back of transfer belt unit 7. Transfer belt 9 is stretched to rotate around rollers 8. Transfer belt 9 is formed as an endless belt having a long width in the left-right direction. Transfer belt 9 runs by following the rotation of rollers 8. Based on the control by controller 3, transfer belt unit 7 rotates rollers 8, thereby causing transfer belt 9 to run, so that transfer belt 9 conveys sheet P received from sheet feeder 5 while carrying sheet P on the top surface of transfer belt 9.

Above transfer belt unit 7, i.e., at a position closer to an upper part than a central part of printer housing 2, four image drum units 11Y, 11M, 11C, and 11K (hereinafter collectively referred to as "image drum unit 11") are sequentially arranged from a back side to a front side of printer housing 2. Image drum units 11Y, 11M, 11C, and 11K correspond to yellow (Y), magenta (M), cyan (C), and black (K), respectively. Further, image drum units 11Y, 11M, 11C, and 11K are similarly configured, and only respective toner colors are different.

Image drum unit 11 serving as an image formation unit is substantially shaped like a box that is relatively long in the left-right direction, to support a lateral width of sheet P. In order to provide the benefit of simplifying replacement and maintenance work on the printer, image drum unit 11 is configured to be attachable to/detachable from printer housing 2 in the left-right direction. Specifically, image drum unit 11 is attached to printer housing 2 while the door on the left-side surface is open, when a user inserts image drum unit 11 into printer housing 2 in a direction from the left side to the right side of printer housing 2. While being inserted, image drum unit 11 is maintained in such a position that a longitudinal direction of image drum unit 11 is parallel to the left-right direction. Image drum unit 11 is detached from printer housing 2, when the user draws image drum unit 11 in a direction toward the left side.

Further, light emitting diode (LED) heads 12Y, 12M, 12C, and 12K (hereinafter collectively referred to as "LED head 12"), each serving as an exposure device, are attached to printer housing 2, corresponding to image drum units 11Y, 11M, 11C, and 11K, respectively. LED head 12 is shaped like a slim rectangular solid extending in the left-right direction. In LED head 12, LED elements are disposed to align in the left-right direction. LED head 12 causes each LED element to emit light in a light emission pattern corresponding to image data supplied from controller 3. When attached to printer housing 2, image drum unit 11 is brought to be extremely close to LED head 12, and performs exposure processing by using the light from LED head 12.

LED head 12 is not a so-called consumable item, and is replaced at a considerably low frequency, during works such as maintenance. Therefore, unlike image drum unit 11, LED head 12 is fixed to printer housing 2.

Further, toner cartridges 14Y, 14M, 14C, and 14K (hereinafter collectively referred to as "toner cartridge 14") are connected to image drum units 11Y, 11M, 11C, and 11K, respectively, via toner feeders 13Y, 13M, 13C, and 13K (hereinafter collectively referred to as "toner feeder 13") disposed above the image drum units, respectively. Toner cartridge 14 is a hollow container long in the left-right direction. Toner cartridge 14 contains toner of each color in powder form, and incorporates a predetermined stirring mechanism. In addition, toner feeder 13 incorporates a send-out mechanism (not illustrated) for sending out the toner in powder form, from an upper part to a lower part.

Transfer belt unit 7 includes four transfer rollers 10Y, 10M, 10C, and 10K (hereinafter collectively referred to as "transfer roller 10"), at respective four positions right below the respective image drum units 11, between front and back rollers 8. In other words, an upper part of transfer belt 9 is interposed between each image drum unit 11 and corresponding transfer roller 10. Transfer roller 10 is capable of being charged.

Controller 3 causes toner cartridge 14 to supply the toner to the toner feeder 13, and then causes toner feeder 13 to supply the toner further to image drum unit 11. Controller 3 also causes LED head 12 to emit the light, to form a light emission pattern corresponding to image data supplied from the host apparatus (not illustrated).

In response to this operation, each image drum unit 11 forms a toner image according to the light emission pattern of LED head 12, by using the toner supplied from toner feeder 13, and transfers this toner image to sheet P (to be described in detail below). Thus, four color toner images corresponding to the image data are sequentially transferred onto sheet P conveyed by transfer belt unit 7.

Fixing unit 16 is provided behind transfer belt unit 7, i.e., at a substantially central position in the vertical direction, in a part in proximity to a rear end of printer housing 2. Fixing unit 16 includes heating roller 17 and pressure roller 18. Heating roller 17 is shaped like a cylinder having a central axis extending in the left-right direction, and incorporates a heater. Pressure roller 18 is shaped like a cylinder similar to heating roller 17. Pressure roller 18 presses an upper surface thereof against a lower surface of heating roller 17 by exerting a predetermined pressing force.

Based on the control supplied by controller 3, fixing unit 16 heats heating roller 17, and rotates heating roller 17 and pressure roller 18 in respective predetermined directions. Thus, fixing unit 16 fixes the toner by applying heat and pressure to sheet P received from transfer belt unit 7, namely, sheet P where the four color toner images are overlaid one upon another. Fixing unit 16 then sends sheet P in a rear-upward direction.

Sheet discharger 21 is disposed behind and above fixing unit 16. Ina manner similar to sheet feeder 5, sheet discharger 21 includes a combination of components such as rollers each having a central axis extending in the left-right direction, and a guide for guiding sheet P. Sheet discharger 21 rotates each roller as appropriate according to the control supplied by controller 3, thereby conveying sheet P received from fixing unit 16, as follows. First, sheet discharger 21 conveys sheet P in a rear-upward direction, and then causes sheet P to proceed frontward. Sheet discharger 21 then outputs sheet P to discharge tray 2T formed on the top surface of printer housing 2.

In this way, when performing the print processing, color printer 1 forms the toner image according to the light emission pattern of LED head 12, by using image drum unit 11 corresponding to each color and attached to printer housing 2. Color printer 1 then sequentially transfers the toner images onto sheet P.

1-2. Basic Configuration of Image Formation Unit

Figure 2:
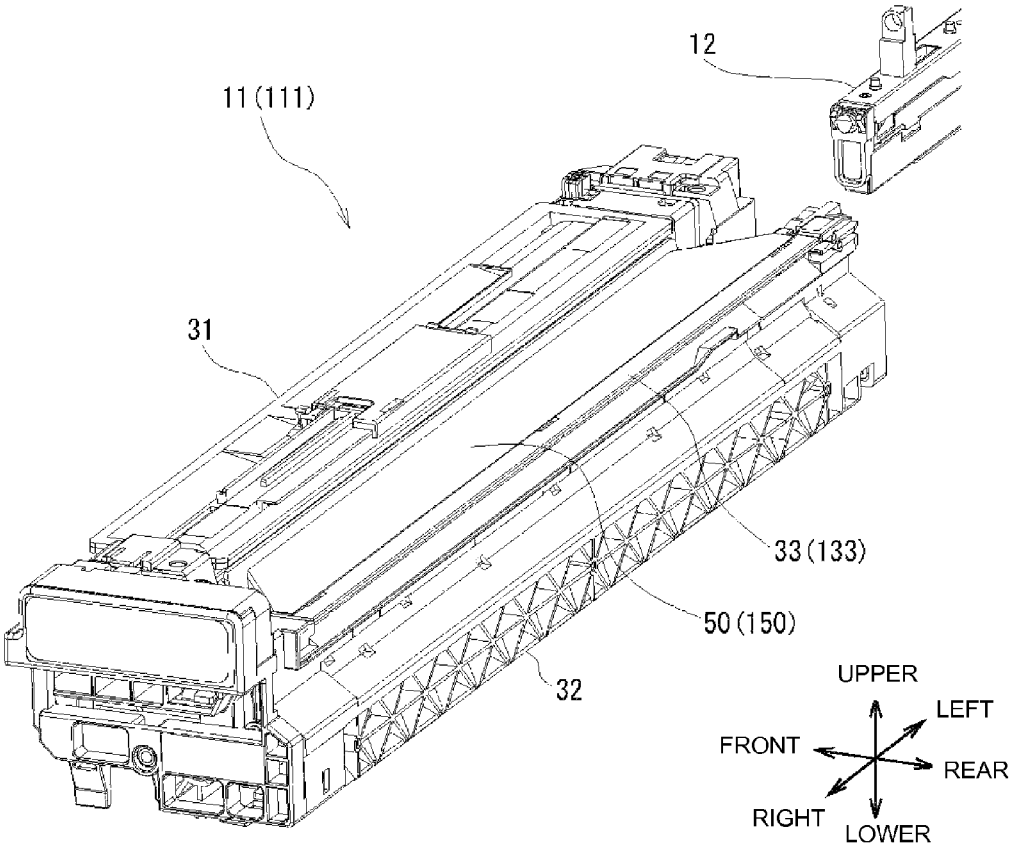
FIG. 2 is a schematic perspective diagram illustrating an appearance configuration of an image drum unit.
Figure 3A:
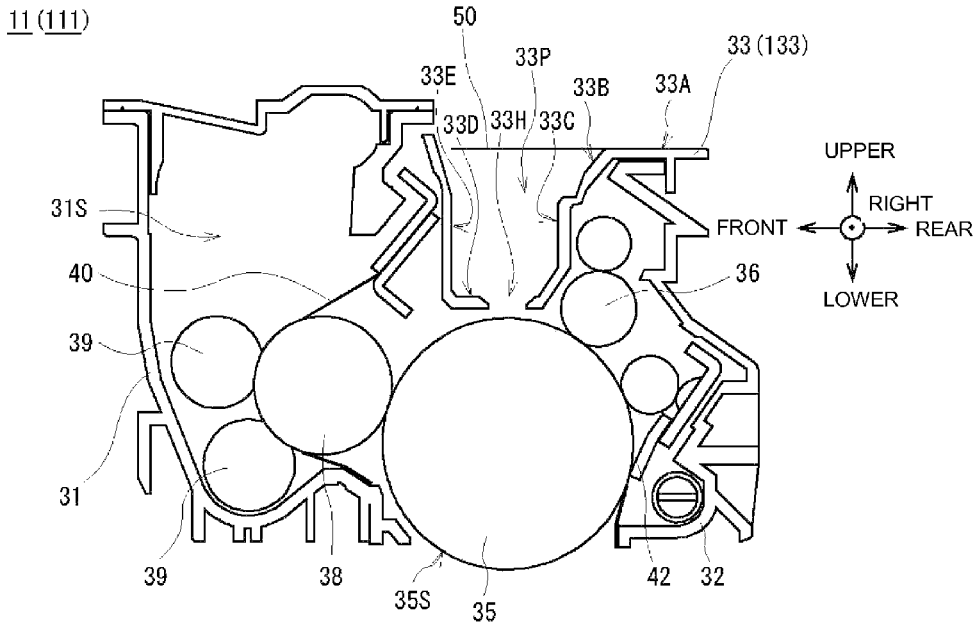
FIGS. 3A and 3B are schematic cross-sectional diagrams illustrating configurations where the image drum unit is respectively detached from, and attached to, the printer housing.
Figure 3B:
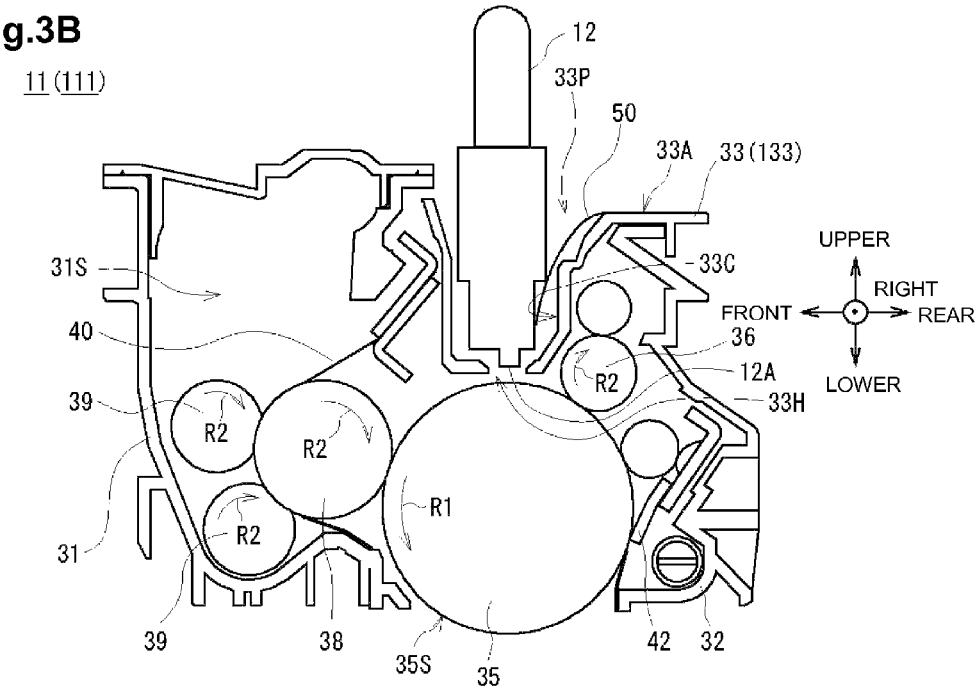

Next, a basic configuration of image drum unit 11 is described. FIG. 2 is a perspective diagram of image drum unit 11. FIGS. 3A and 3B are schematic cross-sectional diagrams of image drum unit 11. Image drum unit 11 is shaped like a rectangular solid long in the left-right direction, as a whole. FIG. 3A illustrates image drum unit 11 alone in a state of being detached from printer housing 2. FIG. 3B illustrates image drum unit 11 in a state of being attached to printer housing 2, together with LED head 12.

The left-right direction, which is an attachment/detachment direction of image drum unit 11, is the main scanning direction of the image formation. The left-right direction is orthogonal to the front-back direction that is the conveyance direction of sheet P, while being parallel to the surface of sheet P placed on the upper part of transfer belt 9.

Image drum unit 11 includes front frame 31 covering a front part thereof, lower frame 32 covering a rear lower part thereof, and upper frame 33 covering a rear upper part thereof, which surrounds the major part of image drum unit 11. Front frame 31, lower frame 32, and upper frame 33 which serve as a housing are each molded of a predetermined resin material, to form a relatively large space inside image drum unit 11.

Photosensitive drum 35 serving as an electrostatic latent image carrier is provided in a lower central part of image drum unit 11, to be interposed between front frame 31 and lower frame 32. Photosensitive drum 35 is shaped like a cylinder having a central axis extending in the left-right direction, and is supported by lower frame 32 to be rotatable about this central axis. When image drum unit 11 is attached to printer housing 2 (FIG. 3B), photosensitive drum 35 rotates in the arrow R1 direction by receiving a driving force transmitted from a motor (not illustrated) provided in printer housing 2.

A lower part of each of front frame 31 and lower frame is partially open to form a relatively wide-open area corresponding to a lower surface of photosensitive drum 35. Therefore, when attached to printer housing 2 (FIG. 1), image drum unit 11 allows the lower part of photosensitive drum 35 to be in contact with transfer belt 9 or sheet P placed on transfer belt 9.

On the other hand, upper frame 33 covers an upper part of lower frame 32, and has groove 33P long in the left-right direction. Groove 33P is recessed downward to be lower than groove periphery 33A located at the top surface. Further, groove 33P has an inner slim space extending in the left-right direction, and is surrounded by groove slant 33B, groove rear 33C, groove bottom 33D, and groove front 33E. Groove slant 33B is located between groove periphery 33A and groove rear 33C, and is inclined to have a surface facing in a diagonally front-upward direction. Groove bottom 33D has a slim exposure opening 33H extending in the left-right direction.

Further, in upper frame 33, groove 33P is located substantially right above photosensitive drum 35, and groove bottom 33D is located in proximity to an upper end of photosensitive drum 35. Furthermore, a distance between groove rear 33C and groove front 33E in groove 33P is sufficiently longer than a length of LED head 12 in the front-back direction.

Therefore, upper frame 33 can protect the rear upper part of image drum unit 11 by using groove periphery 33A and groove 33P. Moreover, when image drum unit 11 is attached to printer housing 2, upper frame 33 can allow light emitting section 12A provided at a lower end of LED head 12, to face a part in proximity to the upper end of photosensitive drum 35 via exposure opening 33H, without interfering with LED head 12, as illustrated in FIG. 3B.

Charging roller 36 is provided above a rear part of photosensitive drum 35. Charging roller 36 is shaped like a cylinder and has a diameter smaller than photosensitive drum 35. Charging roller 36 is made of, for example, a semiconductive elastic material. Charging roller 36 has a peripheral side surface in contact with peripheral side surface 35S of photosensitive drum 35, and charges a contact point of peripheral side surface 35S by being supplied with power from printer housing 2 side.

Development roller 38 is provided in front of photosensitive drum 35. Development roller 38 is shaped like a cylinder and has a diameter smaller than photosensitive drum 35. Development roller 38 is made of, for example, a semiconductive urethane rubber produced by adding a conductive material such as carbon to a urethane rubber material to adjust the electrical resistance appropriately. Thus, development roller 38 is capable of being charged. Development roller 38 has a peripheral side surface in contact with peripheral side surface 35S of photosensitive drum 35, on a rear side of development roller 38. The peripheral side surface of development roller 38 is also in contact with feed roller 39 provided at each of two positions, i.e., upper and lower positions, on a front side of development roller 38. Feed roller 39 is shaped like a cylinder and has a diameter slightly smaller than development roller 38. Feed roller 39 is made of, for example, a semiconductive foaming silicon sponge.

Development blade 40, which is shaped like a thin plate, is provided above development roller 38. Development blade 40 is made of a metallic material such as stainless steel and phosphor bronze, or a rubber material such as silicone rubber. Development blade 40 has a rear upper end fixed inside front frame 31, and a front lower end in contact with the peripheral side surface of development roller 38.

Further, inside front frame 31, toner storage chamber 31S having a relatively wide space is formed above development roller 38, feed roller 39, and development blade 40. Toner storage chamber 31S stores the toner supplied from toner feeder 13 (FIG. 1).

When attached to printer housing 2, image drum unit 11 rotates development roller 38 in the arrow R2 direction by using a driving force supplied from the printer housing 2 side, and also rotates each feed roller 39 in the arrow R2 direction. Further, image drum unit 11 charges development roller 38. The toner supplied from toner storage chamber 31S by feed roller 39 is attached to the peripheral side surface of development roller 38, and then unnecessary toner is scraped off by development blade 40. Therefore, the toner is formed as a uniform thin film.

Further, cleaning blade 42 made of a plate-shaped member is provided at a rear lower part of photosensitive drum 35. Cleaning blade 42 is made of an elastic material such as urethane rubber, epoxy rubber, and acrylic rubber. Cleaning blade 42 has a rear upper end fixed inside lower frame 32, and a front lower end in contact with peripheral side surface 35S of photosensitive drum 35. Cleaning blade 42 brings the front lower end into contact with peripheral side surface 35S, by exerting an elastic force on a rear end of peripheral side surface 35S.

In such a configuration, when attached to printer housing 2, image drum unit 11 positions a lower part of LED head 12, in groove 33P. As a result, light emitting section 12A at the lower end faces a part in proximity to an upper end on peripheral side surface 35S of photosensitive drum 35 via exposure opening 33H (FIG. 3B).

In this state, based on the control supplied by controller 3, image drum unit 11 rotates photosensitive drum 35 in the arrow R1 direction, and also rotates charging roller 36, development roller 38, and each feed roller 39 in the arrow R2 direction. Image drum unit 11 rotates the rollers being in contact with each other, without allowing these rollers to slide against each other.

In photosensitive drum 35, first, a rear upper part of the peripheral side surface 35S is uniformly charged by charging roller 36. Photosensitive drum 35 then causes this charged part to arrive near the upper end by rotating in the arrow R1 direction, so that this charged part faces light emitting section 12A of LED head 12. At this moment, peripheral side surface 35S of photosensitive drum 35 is exposed to light from LED head 12 in a light emission pattern corresponding to image data, so that an electrostatic latent image corresponding to the image data is formed.

Next, photosensitive drum 35 further rotates in the arrow R1 direction. As a result, at a position in proximity to a front end in contact with development roller 38, photosensitive drum 35 allows the toner, formed as a thin layer on the peripheral side surface of development roller 38, to adhere to peripheral side surface 35S. The toner adheres only to a part corresponding to the electrostatic latent image. Thus, a toner image corresponding to the image data is formed on peripheral side surface 35S of photosensitive drum 35. The toner image formed on peripheral side surface 35S at this moment is an image representing only one color component (i.e., any one of yellow, magenta, cyan, and black) corresponding to this image drum unit 11, of an image to be printed finally.

Photosensitive drum 35 then allows the toner image to arrive near a lower end, by further rotating in the arrow R1 direction. Meanwhile, controller 3 causes transfer belt unit 7 (FIG. 1) to bring sheet P to a lower part of image drum unit 11, and charges transfer roller 10. Therefore, in image drum unit 11, sheet P is interposed between a part, on which the toner image is formed, of photosensitive drum 35, and charged transfer roller 10, and this toner image is transferred to sheet P.

Even if some of the toner remains on peripheral side surface 35S without being transferred to sheet P, this remaining toner can be removed as follows. Photosensitive drum 35 further rotates in the arrow R1 direction, thereby carrying this remaining toner forward. Cleaning blade 42 then slides to scrape off the remaining toner arriving at a position facing cleaning blade 42.

In this way, when attached to printer housing 2, image drum unit 11 causes light emitting section 12A of LED head 12 to face a part in proximity to photosensitive drum 35, so that the toner image can be formed on peripheral side surface 35S by an exposure action of LED head 12.

1-3. Configuration of Light-Shielding Film

Besides being configured as described above, image drum unit 11 has light-shielding film 50 serving as a light-shielding member. As a whole, light-shielding film 50 is shaped like a rectangular film. Specifically, as illustrated in FIGS. 2 and 3A, light-shielding film 50 is long in the left-right direction that is the attachment/detachment direction, and short in the front-back direction, while being thin in the vertical direction. Light-shielding film 50 is made of, for example, polyester, and has a property of blocking light (i.e., a light shielding property), besides being flexible as well as rigid to some extent.

Figure 4:
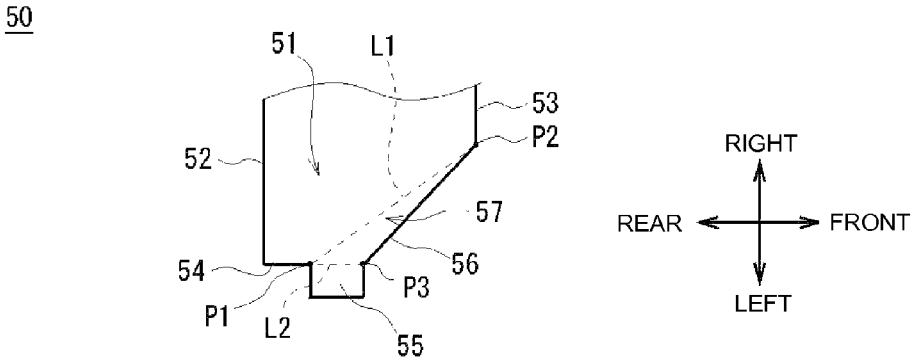
FIG. 4 is a schematic diagram illustrating a state in which a light-shielding film according to a first embodiment is developed.

FIG. 4 illustrates a state of light-shielding film 50 being developed to form a flat surface. Light-shielding film 50 is configured to have plane 51 as a main part. Plane 51 is flat in a natural state. Plane 51 is interposed, in the front-back direction, between rear side 52 serving as one side (a first side) extending along the attachment/detachment direction and front side 53 serving as the other side (a second side). Light-shielding film 50 further includes affixation portion 55 provided in a substantially central part between the front and back, in proximity to a left end. Affixation portion 55 is provided to protrude leftward further than left side 54. Light-shielding film 50 further includes oblique side 56 formed by diagonally cutting off a part in proximity to a vertex on a front left side of light-shielding film 50. Oblique side 56 serves as a guide that links a front part of affixation portion 55 and front side 53.

In the process of manufacturing image drum unit 11, light-shielding film 50 is bent along bend line L1 to form a so-called "mountain fold" shape, so that bend line L1 and a portion near bend line L1 protrude like a ridge. Bend line L1 links connection point P1 connecting between a rear part of affixation portion 55 and left side 54, to connection point P2 connecting between oblique side 56 and front side 53. Further, light-shielding film 50 is bent along bend line L2 to form a so-called "valley fold" shape, so that bend line L2 and a part in proximity to bend line L2 recess like a groove. Bend line L2 links connection point P1 to connection point P3 connecting between the front part of affixation portion 55 and oblique side 56.

As illustrated in FIG. 5 and FIGS. 6A to 6C, light-shielding film 50 is affixed to image drum unit 11, by being affixed to upper frame 33 with a double-faced adhesive tape (not illustrated). Specifically, the under-surface of light-shielding film 50 is affixed with double-faced adhesive tape to groove periphery 33A of upper frame 33, over a long range in the left-right direction, in proximity to rear side 52. Thus, in light-shielding film 50, a part at rear side 52 becomes a fixed end that is fixed to image drum unit 11, and an opposite part at front side 53 becomes a free end that is freely displaced mainly in the vertical direction.

Figure 5:
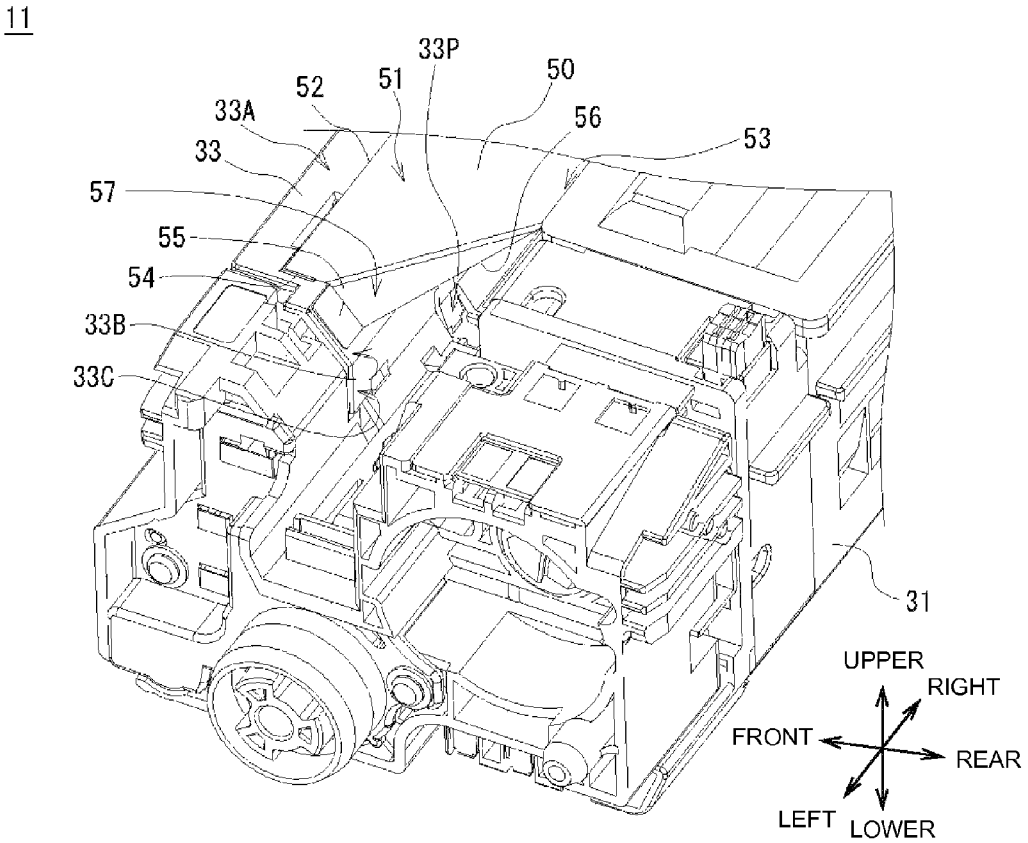
FIG. 5 is a schematic perspective diagram illustrating a configuration of the light-shielding film according to the first embodiment.
Figure 6A:
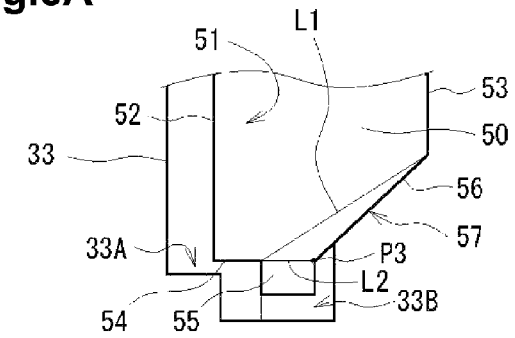
FIGS. 6A, 6B, and 6C are schematic diagrams illustrating a configuration of the light-shielding film according to the first embodiment, which are a plan view, a left-side view, and a front view, respectively.
Figure 6B:
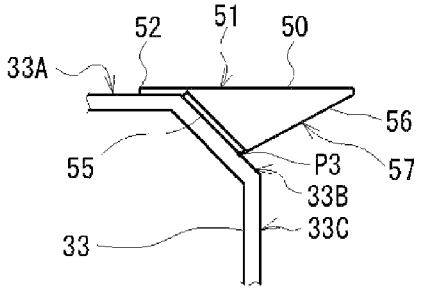
Figure 6C:
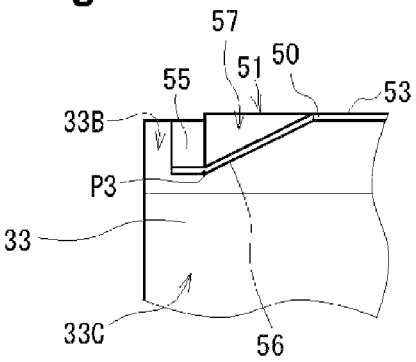

When image drum unit 11 is detached from printer housing 2, light-shielding film 50 is in a natural state without receiving an external force, as illustrated in FIGS. 2, 3A, and 5. Thus, light-shielding film 50 closes an upper part of groove 33P, by spreading plane 51 to form a substantially flat surface.

Further, of light-shielding film 50, an under surface of affixation portion 55 is affixed to groove slant 33B of upper frame 33, with a double-faced adhesive tape. Therefore, in light-shielding film 50, a region surrounded by oblique side 56, bend line L1, and bend line L2 (FIG. 4) is in a state of sloping down at a front left part of substantially flat plane 51, as illustrated in FIG. 5 and FIGS. 6A to 6C. This region is hereinafter referred to as "slope section 57".

In this way, light-shielding film 50 has slope section 57 formed at the left end, which comes in contact with LED head 12 first when image drum unit 11 is attached to printer housing 2. Slope section 57 slopes down at the front left part of plane 51.

1-4. Operation and Effect

As described above, color printer 1 according to the first embodiment is configured as follows. Groove 33P is formed in upper frame 33 of image drum unit 11. LED head 12 is positioned in proximity to photosensitive drum 35, when image drum unit 11 is attached to printer housing 2. Image drum unit 11 includes light-shielding film 50 provided to cover groove 33P. Slope section 57 serving as a guide is formed to be lower than plane 51 by affixing affixation portion 55 to groove slant 33B, which is formed to be lower than groove periphery 33A of upper frame 33, at a left end part of light-shielding film 50.

When image drum unit 11 is detached from printer housing 2, light-shielding film 50 is in a natural state, and plane 51 is in a closing state of covering groove 33P by being substantially flat. Therefore, in image drum unit 11, light-shielding film 50 can prevent external light from entering exposure opening 33H (FIG. 3A) formed in groove bottom 33D of upper frame 33. In other words, light-shielding film 50 can prevent photosensitive drum 35 from being exposed to light unintentionally. As a result, color printer 1 can prevent degradation in quality of an image printed on sheet P, which occurs when an incomplete toner image is formed by photosensitive drum 35 exposed to light.

To be attached to printer housing 2, image drum unit 11 is inserted starting from the left end part of image drum unit 11, in a state in which the door (not illustrated) provided on the left-side surface of printer housing 2 is open (FIG. 2). Image drum unit 11 has slope section 57 formed at the left end. Therefore, the part of light-shielding film 50 that comes in contact with LED head 12 first is oblique side 56.

As image drum unit 11 is inserted into printer housing 2, a right rear side of LED head 12 applies a relatively rightward force to oblique side 56 of light-shielding film 50. Therefore, due to elastic and rigid actions, light-shielding film 50 deforms while being pushed aside by LED head 12 in response to the force applied by LED head 12. In other words, light-shielding film 50 deforms to displace oblique side 56 upward or downward.

Connection point P3, that is a left end of oblique side 56, is located on groove slant 33B of upper frame 33. Connection point P3 also serves as a front right end of affixation portion 55 affixed to groove slant 33B. Therefore, connection point P3 is hardly pulled away from groove slant 33B.

For this reason, when the relatively rightward force is applied from LED head 12 to oblique side 56, light-shielding film 50 gradually displaces oblique side 56 by using connection point P3 as a fulcrum. Following this displacement, a sloping direction of the front part in slope section 57 gradually changes so that the front part leans further frontward. Accordingly, light-shielding film 50 gradually bends frontward, starting from a part in proximity to oblique side 56 and front side 53 in plane 51 pulled by slope section 57, while causing oblique side 56 or front side 53 to slide against a rear side surface of LED head 12.

In other words, in light-shielding film 50, affixation portion 55 is affixed to groove slant 33B disposed lower than plane 51, to prevent oblique side 56 and slope section 57 from readily moving upward. In addition, slope section 57 slopes in a left frontward direction. Therefore, since oblique side 56 of light-shielding film 50 is caused to abut LED head 12 first, image drum unit 11 can lean slope section 57 gradually frontward, without allowing oblique side 56 to move upward, and further can gradually bend plane 51 forward, continuously from slope section 57.

Assume that image drum unit 11 is positioned relatively lower than LED head 12. In this case, oblique side 56 or slope section 57 of light-shielding film 50 is caused to abut a right-rear lower vertex or a right lower side of LED head 12 first, instead of abutting the right rear side of LED head 12. Therefore, as image drum unit 11 is inserted into printer housing 2, LED head 12 applies a downward force to oblique side 56 or slope section 57, so that light-shielding film 50 can allow a part close to front side 53 to bend downward gradually.

Subsequently, when image drum unit 11 is completely attached to printer housing 2, front side 53 is positioned deep in groove 33P to sit behind LED head 12. As a result, light-shielding film 50 is in a retracted state in which the entire light-shielding film 50 is gently bent, as illustrated in FIG. 3B. Thus, light-shielding film 50 allows LED head 12 to perform the exposure processing smoothly, by not becoming an obstruction between light emitting section 12A of LED head 12 and photosensitive drum 35.

In the detachment of image drum unit 11 from printer housing 2, the external force applied from LED head 12 is released, allowing an elastic force of light-shielding film 50 to act. Therefore, light-shielding film 50 gradually returns to its original state, starting from the point released from the abutment on LED head 12. When image drum unit 11 is completely detached from printer housing 2, light-shielding film 50 fully returns to its original state (FIG. 3A). At this moment, neither a crease nor a fold is formed on light-shielding film 50, and light-shielding film 50 is not peeled away from upper frame 33. Therefore, by returning to its original state, the original state can cover groove 33P again to protect photosensitive drum 35 from unintentional exposure.

Assume that light-shielding film 50 is substantially a flat surface without oblique side 56 and slope section 57 at the left end. In this case, a crease or fold may be formed or light-shielding film 50 may be peeled away from upper frame 33 by being lifted, when a rightward force is applied from LED head 12 to the left end of light-shielding film 50. A conceivable issue in the case is that, when image drum unit 11 is detached from printer housing 2, light-shielding film 50 may become unable to close groove 33P, and thus become unable to shield photosensitive drum 35. In this respect, light-shielding film 50 according to the present embodiment mode includes elements such as oblique side 56 and slope section 57 at the left end, and therefore can reliably avoid such an issue.

According to the present embodiment, as compared with a conventional case where a light-shielding film is configured as a simple plane, light-shielding film 50 only needs to be configured as follows. Light-shielding film 50 has additional parts such as affixation portion 55 and oblique side 56 formed at the left end part. Light-shielding film 50 is bent along bend lines L1 and L2. Further, affixation portion 55 is affixed to groove slant 33B with the double-faced adhesive tape. In other words, in image drum unit 11, it is unnecessary to increase the number of components and to change the design, for making an improvement from the conventional case. Further, it is also unnecessary to change the shape of a part provided with LED head 12. Moreover, an increase in the number of manufacturing processes can be considerably small.

As described above, color printer 1 according to the first embodiment is configured as follows. Affixation portion 55 is affixed to groove slant 33B of upper frame 33, at the left end part of light-shielding film 50 of image drum unit 11. Therefore, oblique side 56 is positioned to be lower than plane 51, and slope section 57 is formed to slope down at the front left part of plane 51. Thus, in color printer 1, when image drum unit 11 is attached to printer housing 2, oblique side 56 of light-shielding film 50 is caused to abut LED head 12 first, so that light-shielding film 50 can lean forward gradually and continuously from slope section 57 to plane 51, without allowing oblique side 56 to move upward. As a result, in color printer 1, front side 53 is eventually positioned behind LED head 12 in groove 33P, and the entire light-shielding film 50 bends gently, while still being able to return to its original state.

2. Second Embodiment

Color printer 101 (FIG. 1) according to a second embodiment is configured in a manner similar to color printer 1 according to the first embodiment, except for the following. In place of image drum units 11 (11Y, 11M, 11C, and 11K), image drum units 111Y, 111M, 111C, and 111K (hereinafter collectively referred to as "image drum unit 111") are attached to color printer 101.

2-1. Configuration of Image Drum Unit

Image drum unit 111 (FIGS. 2 and 3) is configured in a manner similar to image drum unit 11 according to the first embodiment, except that upper frame 133 and light-shielding film 150 are provided in place of upper frame 33 and light-shielding film 50.

Figure 7:
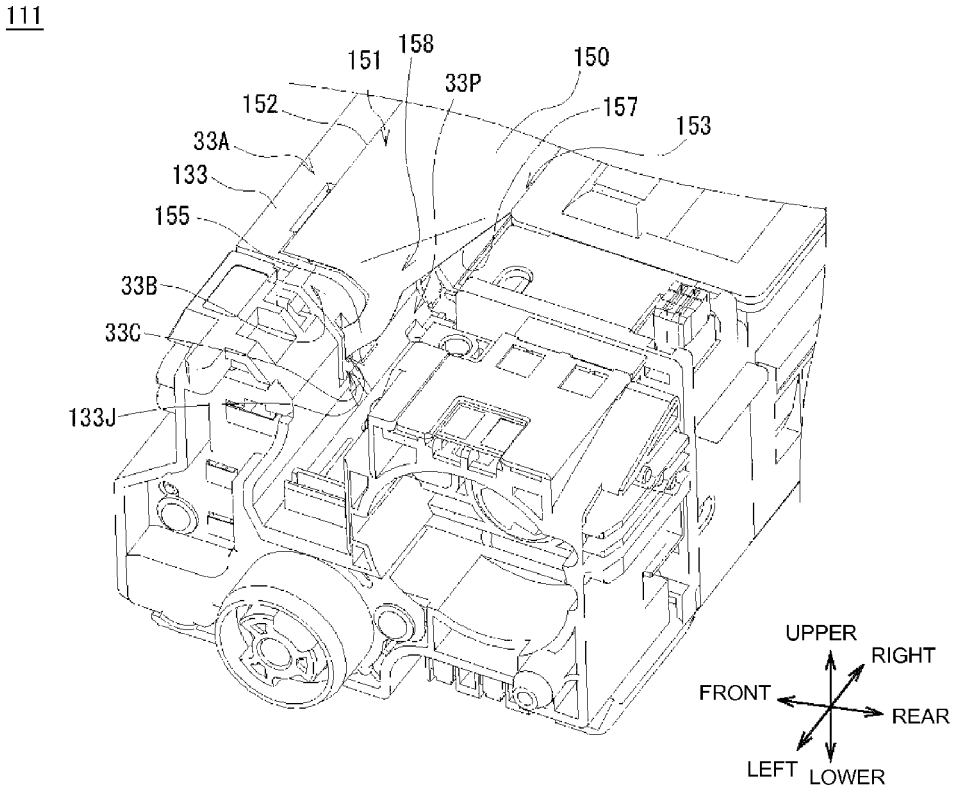
FIG. 7 is a schematic perspective diagram illustrating a configuration of a light-shielding film according to a second embodiment.

Unlike upper frame 33, upper frame 133 has a slim engagement hole 133J extending in the vertical direction, in proximity to a left end of groove rear 33C in groove 33P, as illustrated in FIG. 7 corresponding to FIG. 5. Except for this point, upper frame 133 is configured in a manner similar to upper frame 33.

Light-shielding film 150 serving as a light-shielding member has plane 151, rear side 152, front side 153, and left side 154 similar to plane 51, rear side 52, front side 53, and left side 54 of light-shielding film 50, respectively. However, unlike light-shielding film 50, light-shielding film 150 has arm 155 and engagement nail 156 in place of affixation portion 55.

Arm 155 is formed at a frontward position at a left end of light-shielding film 150, to protrude leftward further than left side 154. Engagement nail 156 is formed in proximity to a tip of a rear side (i.e., in proximity to a left end) in arm 155, to protrude rearward like a hook. In other words, on the right side of engagement nail 156, arm 155 forms a constricted part having a relatively small width in the front-back direction, over a distance long to some extent in the left-right direction. Further, a front side of arm 155 is located slightly rearward than front side 153 of the entire light-shielding film 150. Oblique side 157 is formed as a guide, between the front side of arm 155 and front side 153.

In the process of manufacturing image drum unit 111, light-shielding film 150 is first processed in a manner similar to light-shielding film 50. Specifically, as illustrated in FIG. 7, in a state in which the top surface of plane 151 faces upward, an under surface of plane 151 is affixed to groove periphery 33A of upper frame 133 with a double-faced adhesive tape, over a long range extending in the left-right direction, in proximity to rear side 152.

Figure 9A:
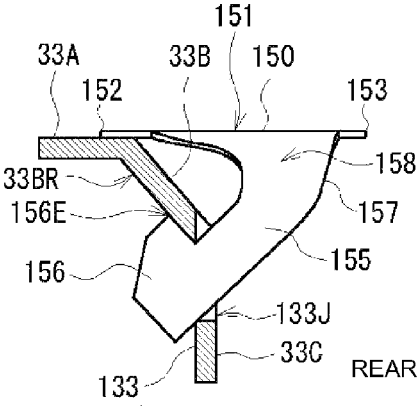
FIGS. 9A and 9B are schematic cross-sectional diagrams illustrating a configuration of the light-shielding film according to the second embodiment.
Figure 9B:
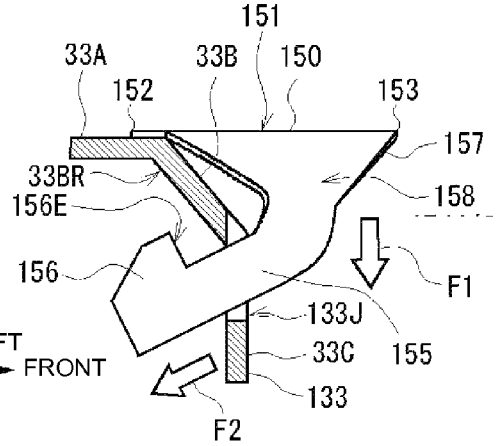

Next, a part of light-shielding film 150 at a tip (i.e., at the left end) of arm 155 is obliquely curved in a rear-downward direction, as illustrated in the cross-sectional diagrams of FIGS. 9A and 9B. Simultaneously, engagement nail 156 is inserted into engagement hole 133J of upper frame 133, in a state of being folded to overlap arm 155 temporarily. Thus, slope section 158 serving as a guide is formed in light-shielding film 150, to curve continuously from substantially flat plane 151, over a range from a front left part of light-shielding film 150, i.e., a part in proximity to oblique side 157, to entire arm 155. In slope section 158, an angle of sloping in a left-front downward direction becomes steeper, toward a front left side. Unlike planar slope section 57 in the first embodiment, slope section 158 forms a curved surface bulging upward as a whole.

Further, in light-shielding film 150, engagement nail 156 develops to form a plane contiguous to arm 155 due to the action of an elastic force, at a position below groove slant 33B in upper frame 133. As a result, engagement side 156E of engagement nail 156 abuts rear undersurface 33BR of groove slant 33B. Therefore, in light-shielding film 150, arm 155 can be inserted deeper into engagement hole 133J as illustrated in FIG. 9B. Alternatively, arm 155 can be pulled back to a position where engagement side 156E abuts rear undersurface 33BR, but cannot be removed from engagement hole 133J, as illustrated in FIG. 9A. In other words, light-shielding film 150 maintains slope section 158 in a position sloping downward at the front left part of plane 151.

In this way, as with the first embodiment, light-shielding film 150 has slope section 158 formed at the left end, which first abuts on LED head 12 when image drum unit 111 is attached to printer housing 2. Slope section 158 slopes in a left-front downward direction relative to plane 151.

2-2. Operation and Effect

In color printer 101 according to the second embodiment having the above-described configuration, groove 33P is formed in upper frame 133 of image drum unit 111, and LED head 12 is positioned in proximity to photosensitive drum 35 when image drum unit 111 is attached to printer housing 2. Further, in image drum unit 111, light-shielding film 150 is provided to cover groove 33P, and at the left end part of light-shielding film 150, slope section 158 having the curved surface is formed to be lower than plane 151. Slope section 158 is formed by inserting the tip of arm 155 into engagement hole 133J of upper frame 133, to engage engagement nail 156 with rear undersurface 33BR of groove slant 33B.

When image drum unit 111 is detached from printer housing 2, light-shielding film 150 is in a natural state as with the first embodiment. Therefore, plane 151 becomes substantially flat to cover groove 33P, so that unintentional exposure of photosensitive drum 35 can be prevented.

Further, image drum unit 111 has slope section 158 formed at the left end. Therefore, oblique side 157 or slope section 158 of light-shielding film 150 is caused to abut LED head 12 first, when image drum unit 111 is attached to printer housing 2. In light-shielding film 150, when image drum unit 111 is inserted into printer housing 2, a rightward force is applied from a right rear side of the right of LED head 12 to oblique side 157 or slope section 158.

At this moment, in light-shielding film 150, engagement nail 156 provided in proximity to the tip of arm 155 cannot be removed from engagement hole 133J and thus, oblique side 157 and slope section 158 are not lifted up. Therefore, oblique side 157 or slope section 158 is caused to slide against the right rear side of LED head 12, so that light-shielding film 150 is pushed aside by LED head 12 to lean in the arrow F1 direction. As a result, while inserting arm 155 deeper into engagement hole 133J in the arrow F2 direction (FIG. 9B), light-shielding film 150 deforms to displace oblique side 157 and slope section 158 downward. Thus, a sloping direction of the front part in slope section 158 gradually changes, so that the front part leans further frontward.

Afterward, as image drum unit 111 is inserted into printer housing 2, light-shielding film 150 gradually bends forward starting from a part in proximity to oblique side 157 or front side 153 in plane 151 pulled by slope section 158, while causing oblique side 157 or front side 153 to slide against a rear side surface of LED head 12.

In other words, light-shielding film 150 causes engagement nail 156 provided at the tip of arm 155 to engage with rear undersurface 33BR of groove slant 33B, at a position lower than plane 151, thereby preventing oblique side 157 and slope section 158 from readily moving upward. Simultaneously, light-shielding film 150 causes slope section 158 to lean in a left-forward direction. Thus, in image drum unit 111, by allowing oblique side or slope section 158 of light-shielding film 150 to abut LED head 12 first, slope section 158 can gradually leans forward, and further, plane 151 can gradually face forward continuously from slope section 158.

In addition, light-shielding film 150 changes the depth of insertion of arm 155 into engagement hole 133J, according to a force applied from LED head 12 to the slope section 158 and the like. Specifically, when a downward or rearward force is applied from LED head 12 to the slope section 158 and the like, light-shielding film 150 allows slope section 158 and plane 151 contiguous thereto to bend downward, thereby inserting arm 155 deeper into engagement hole 133J (FIG. 9B). Therefore, in light-shielding film 150, slope section 158 and arm 155 are not forcibly bent and neither a crease nor a fold is formed. Accordingly, light-shielding film 150 can cover groove 33P by reliably returning to its original state, even when image drum unit 111 is removed from printer housing 2.

Moreover, in the second embodiment, as compared with a conventional case where a light-shielding film is a simple plane, light-shielding film 150 only needs to have additional parts such as arm 155, engagement nail 156, and oblique side 157 formed at the left end part, and to have engagement hole 133J formed in upper frame 133. In other words, in image drum unit 111, it is unnecessary to increase the number of components and to change the design, for making an improvement from the conventional case, as with the first embodiment. Further, it is also unnecessary to change the shape of apart provided with LED head 12. Moreover, an increase in the number of manufacturing processes can be considerably small.

As described above, color printer 101 according to the second embodiment is configured as follows. At the left end part of light-shielding film 150 of image drum unit 111, arm 155 having engagement nail 156 at the tip is inserted into engagement hole 133J of upper frame 33. As a result, oblique side 157 and slope section 158 are positioned to be lower than plane 151, and slope section 158 is formed to slope in a left-front downward direction. Thus, in color printer 101, when image drum unit 111 is attached to printer housing 2, oblique side 157 or slope section 158 of light-shielding film 150 is caused to abut LED head 12 first. Therefore, light-shielding film 150 can lean forward gradually and continuously from slope section 158 to plane 151, without allowing oblique side 157 or slope section 158 to move upward. As a result, in color printer 101, front side 153 is eventually positioned behind LED head 12 in groove 33P, and the entire light-shielding film 150 bends gently, while being able to return to the original state.

3. Other Embodiments

Figure 10A:
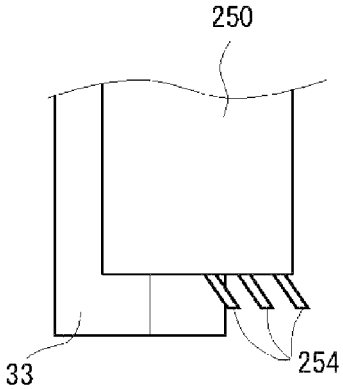
FIGS. 10A and 10B are schematic diagrams illustrating a configuration of a light-shielding film according to another embodiment.
Figure 10B:
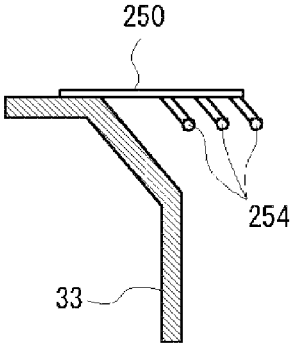

In the above-described first embodiment, slope section 57 is formed by inclining the part in proximity to the front left end of light-shielding film 50. However, the invention is not limited to this case. For example, light-shielding film 250 illustrated in FIGS. 10A and 10B may be adopted. Light-shielding film 250 has slim guide member 254 shaped like a rod and provided to extend from a front left end in an obliquely left-downward direction. Without being limited to a flat or curved surface, a member in any of various shapes may be provided at the left end of a light-shielding film, to serve in a manner similar to slope section 57. This also holds true for the second embodiment.

Figure 11:
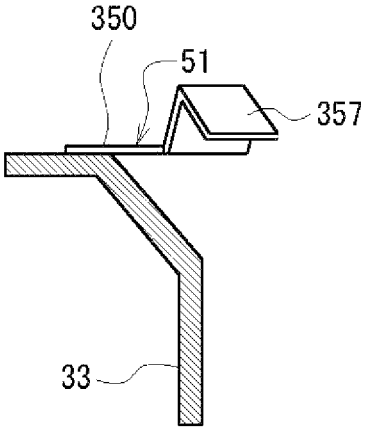
FIG. 11 is a schematic diagram illustrating a configuration of a light-shielding film according to yet another embodiment.

In the above-described first embodiment, slope section is formed at the position lower than plane 51 of light-shielding film 50 and close to groove bottom 33D of groove 33P. However, the invention is not limited to this case. For example, light-shielding film 350 illustrated in FIG. 11 may be adopted. In light-shielding film 350, slope section 357 is formed at a position higher than plane 51 and away from groove bottom 33D of groove 33P. This also holds true for the second embodiment.

In the above-described first embodiment, slope section 57 is formed by inclining a plane part contiguous to plane 51 of light-shielding film 50. However, the invention is not limited to this case. For example, with respect to light-shielding film 50, a component independent of plane 51 may be formed at the left end and slope section 57 may be formed at this component. This also holds true for the second embodiment.

Figure 12:
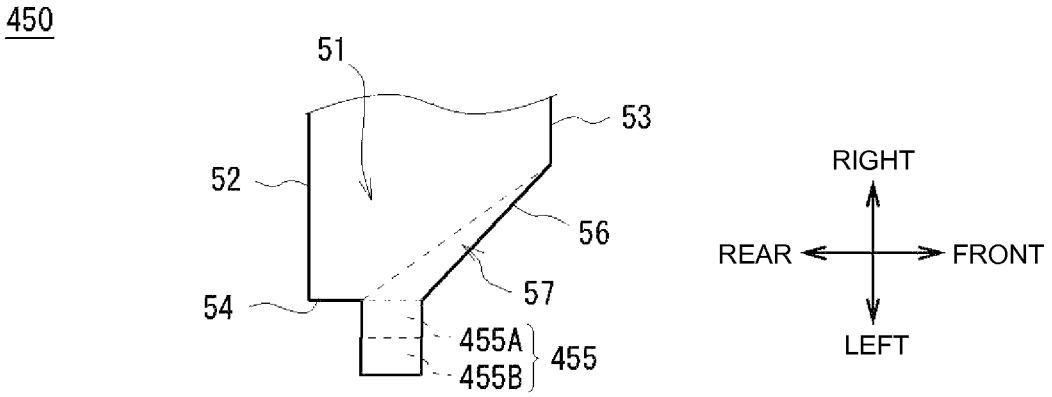
FIG. 12 is a schematic diagram illustrating a state in which a light-shielding film according to yet another embodiment is developed.
Figure 13:
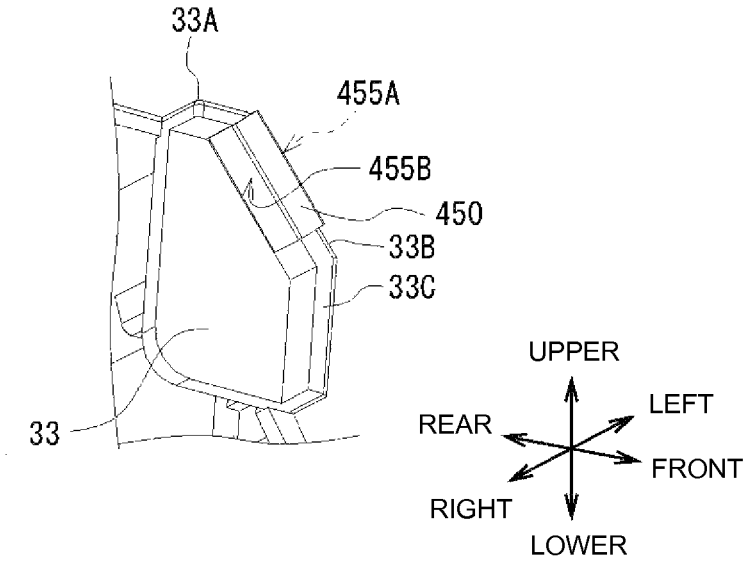
FIG. 13 is a schematic perspective diagram illustrating a configuration of the light-shielding film illustrated in FIG. 12.
Figure 14:
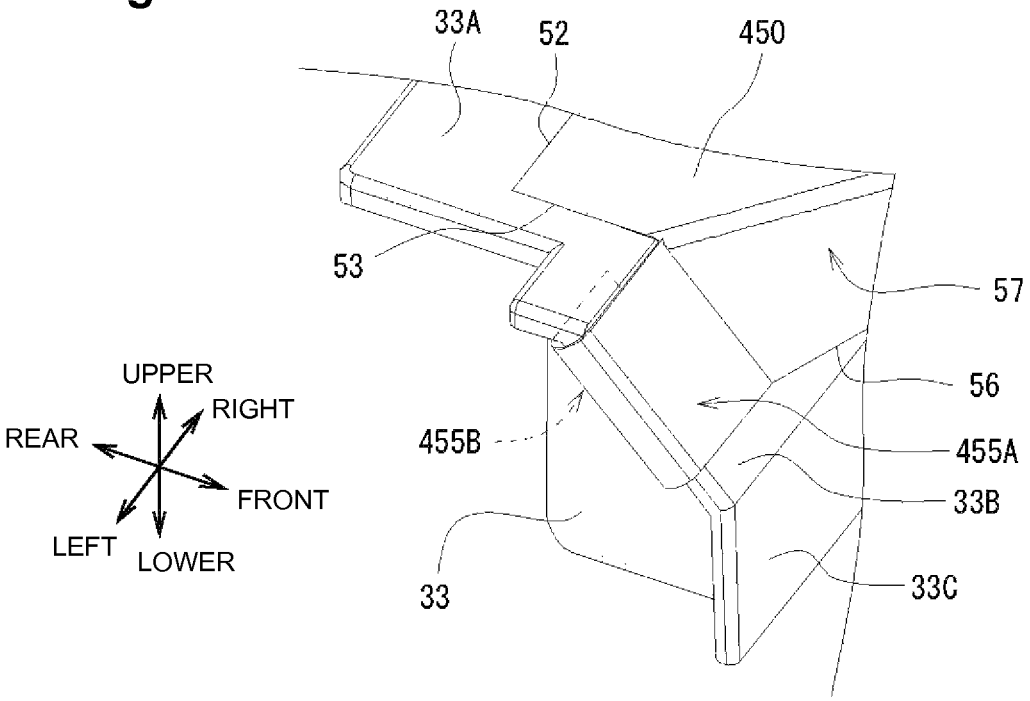
FIG. 14 is another schematic perspective diagram illustrating the configuration of the light-shielding film illustrated in FIG. 12.

In the above-described first embodiment, affixation portion 55 is affixed only to a top surface of groove slant 33B of upper frame 33 (FIG. 5 and FIGS. 6A to 6C). However, the invention is not limited to this case. For example, light-shielding film 450 illustrated in FIG. 12 corresponding to FIG. 4 may be adopted. Light-shielding film 450 has affixation portion 455 having a shape similar to affixation portion 55 when extended mainly in the left-right direction. As illustrated in the perspective diagrams of FIGS. 13 and 14, in light-shielding film 450, root 455A close to slope section 57 is affixed to the top surface of groove slant 33B, and tip 455B away from slope section 57 is affixed to the under surface of groove slant 33B. Therefore, affixation portion 455 can be less likely to come off upper frame 33 when light-shielding film 450 abuts LED head 12.

Figure 15:
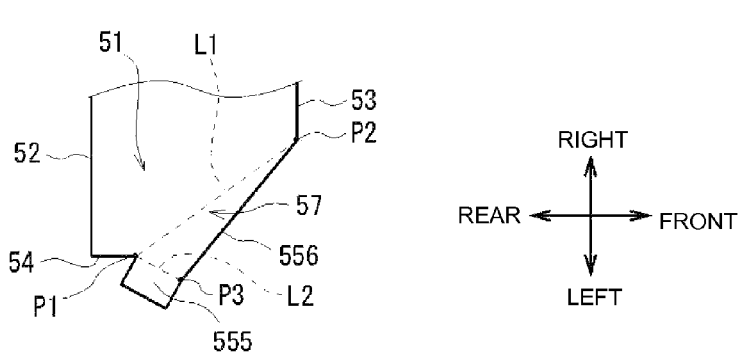
FIG. 15 is a schematic diagram illustrating a state in which a light-shielding film according to yet another embodiment is developed.

In the above-described first embodiment, affixation portion 55 is provided to extend leftward relative to plane 51 in the state of light-shielding film 50 being developed (FIG. 4). However, the invention is not limited to this case. For example, light-shielding film 550 illustrated in FIG. 15 corresponding to FIG. 4 may be adopted. In light-shielding film 550, affixation portion 555 is provided to extend obliquely in a left-frontward direction relative to plane 51. In this case, the extending direction of affixation portion 55 (or 555) relative to plane 51 may be any of various directions, depending on a desired angle of inclination of slope section 57 (or 557) relative to plane 51, or an angle of inclination of groove slant 33B relative to groove periphery 33A.

In the above-described first embodiment, a part of light-shielding film 50 is bent to form planar slope section 57, and in the second embodiment, a part of light-shielding film 150 is curved to form slope section 158 shaped like a curved surface. However, the invention is not limited to these cases, and a slope having a surface taking any of various shapes may be formed.

In the above-described first embodiment, affixation portion 55 is fixed to groove slant 33B of upper frame 33, by being affixed with the double-faced adhesive tape (not illustrated). However, the invention is not limited to this case. For example, affixation portion 55 may be fixed to groove slant 33B of upper frame 33 by using a known adhesive, a screw, a clip, or the like.

In the above-described first embodiment, affixation portion 55 is fixed by being affixed to groove slant 33B of upper frame 33. However, the invention is not limited to this case. For example, if groove slant 33B is omitted from groove 33P, affixation portion 55 may be fixed by being affixed to any of various parts such as groove rear 33C of upper frame 33. In this case, the part to which affixation portion 55 is affixed is at a position lower than groove periphery 33A in upper frame 33. This is because, desirably, slope section 57 is formed to be lower than plane 51, i.e., at a position close to groove bottom 33D of groove 33P, and slopes in a left-rear downward direction.

Figure 8:
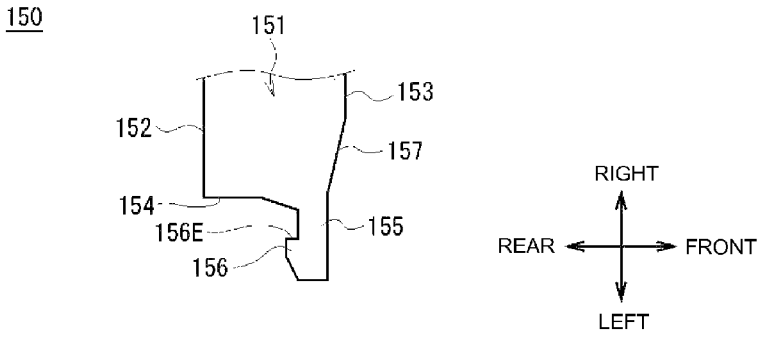
FIG. 8 is a schematic diagram illustrating a state in which the light-shielding film according to the second embodiment is developed.
Figure 9B:
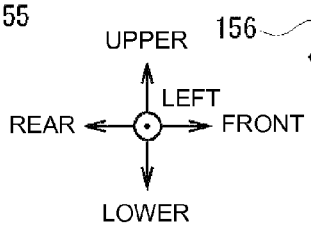
Figure 16:
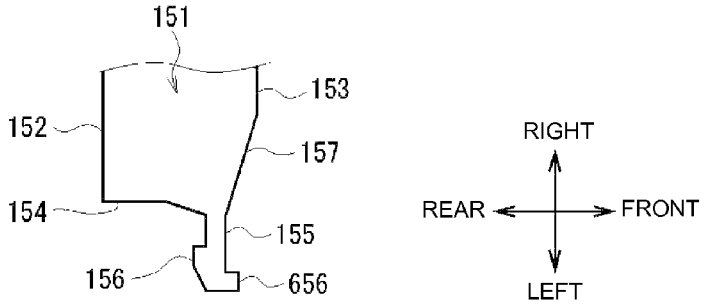
FIG. 16 is a schematic diagram illustrating a state in which a light-shielding film according to yet another embodiment is developed.
Figure 17A:
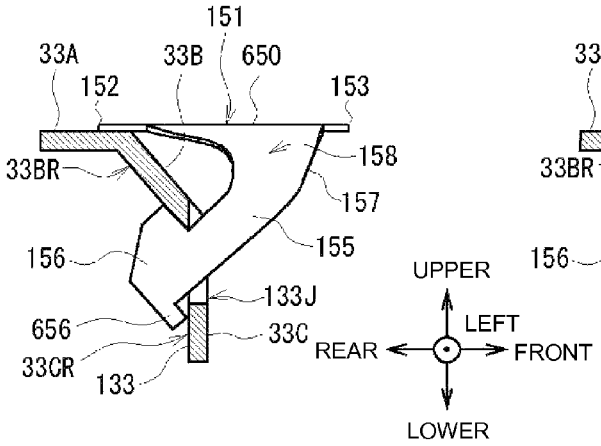
FIGS. 17A and 17B are schematic cross-sectional diagrams illustrating a configuration of the light-shielding film illustrated in FIG. 16.
Figure 17B:
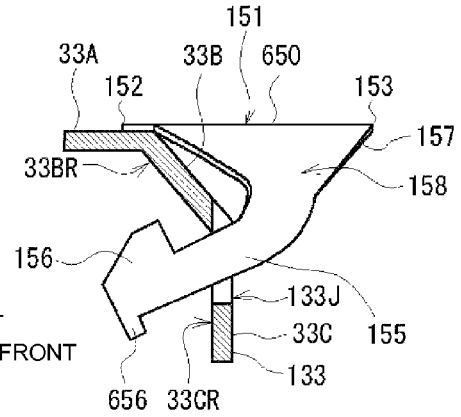

In the above-described second embodiment, engagement nail 156 is provided only on the rear side of arm 155 of light-shielding film 150. However, the invention is not limited to this case. For example, light-shielding film 650 illustrated in FIG. 16 corresponding to FIG. 8 may be adopted. In light-shielding film 650, engagement nail 656 is additionally provided on front side of arm 155. In this case, as illustrated in FIGS. 17A and 17B corresponding to FIG. 9, when engaging engagement nail 156 with rear undersurface 33BR of groove slant 33B by abutment, light-shielding film 650 can engage engagement nail 656 with front surface 33CR of groove rear 33C by abutment. This can make it hard to remove arm 155 from engagement hole 133J.

Alternatively, engagement nail 156 may be omitted and only engagement nail 656 may be provided at arm 155. Still alternatively, engagement nail 156 may be omitted from arm 155, and a separate stop member (not illustrated) may be attached to the tip of arm 155 in a state of this tip being inserted into engagement hole 133J. In other words, slope section 158 may be maintained by keeping the state in which the tip of arm 155 is inserted into engagement hole 133J.

In the above-described second embodiment, arm 155 is formed to be relatively long as illustrated in FIGS. 9A and 9B, so that the depth of the insertion of arm 155 into engagement hole 133J changes according to the force applied to slope section 158. However, the invention is not limited to this case. For example, arm 155 may be formed to be relatively short, so that the depth of insertion of arm 155 into engagement hole 133J is not allowed to change.

Furthermore, in the above-described first embodiment, oblique side 56 is formed by diagonally cutting off the part in proximity to the end on the front left side of light-shielding film 50. However, the invention is not limited to this case. For example, the part in proximity to the end on the front left side of light-shielding film 50 may be maintained so as not to form oblique side 56. This also holds true for the second embodiment.

In the above-described first embodiment, slope section 57 is provided only on the left side of light-shielding film 50. However, the invention is not limited to this case. For example, a slope section forming left-right symmetry with slope section 57 may be additionally provided on the right side of light-shielding film 50. This also holds true for the second embodiment.

In the above-described first embodiment, four image drum units 11 corresponding to yellow, magenta, cyan, and black are attached to printer housing 2 of color printer 1 that performs color printing. However, the invention is not limited to this case. For example, depending on the number of toner colors used in a color printer, three or more, or five or more image drum units 11 may be attached to printer housing 2. Moreover, one image drum unit 11 may be attached to a monochrome printer that performs monochrome printing. This also holds true for the second embodiment.

In the above-described first embodiment, photosensitive drum 35 is exposed to light by LED head 12 equipped with the LED. However, the invention is not limited to this case. For example, photosensitive drum 35 may be exposed to light by a laser head equipped with a laser element. This also holds true for the second embodiment.

In the above-described first embodiment, the invention is applied to color printer 1 serving as the image formation apparatus. However, the invention is not limited to this case. The invention is applicable to any other types of apparatus similar to color printer 1 configured as follows. In color printer 1, LED head 12 is fixed on the housing side, and image drum unit 11 is detachably attachable to the housing, in the direction orthogonal to the conveyance direction of sheet P while being parallel with the surface of sheet P. Examples of the any other types of apparatus include a facsimile, a multi function product (MF), and a copier. This also holds true for the second embodiment.

The invention is not limited to each of the embodiments and other embodiments described above. In other words, a scope of application of the invention covers an embodiment in which each of the embodiments is freely combined with some or all of the other embodiments described above, and an embodiment configured by extracting each of the embodiments and other embodiments described above.

In the above-described first embodiment, image drum unit 11 serving as the image formation unit includes: photosensitive drum 35 serving as the electrostatic latent image carrier, and front frame 31, lower frame 32, and upper frame 33 serving as the housing, groove 33P serving as the groove, light-shielding film 50 serving as the light-shielding member, as well as slope section 57 and oblique side 56 serving as the guide. Color printer 1 serving as the image formation apparatus includes this image drum unit 11. However, the invention is not limited to this embodiment. For example, the image formation unit may include the electrostatic latent image carrier, the housing, the groove, the light-shielding member, and the guide, which may each have any of various configurations, and the image formation apparatus may include this image formation unit.

The invention may be widely utilized for apparatuses such as a color printer in which light of a laser or an LED is utilized for exposure.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

an electrostatic latent image carrier configured to carry an electrostatic latent image thereon to be formed by exposure light from an exposure device provided in an image formation apparatus main body;

a housing containing the electrostatic latent image carrier therein, and configured to detachably attach to the image formation apparatus main body in an attachment/detachment direction along a main scanning direction of the exposure device;

a groove formed at the housing extending in the attachment/detachment direction, and configured such that, in a state where the housing is attached to the image formation apparatus main body, a light emitting section of the exposure device is positioned in the groove to proximately face the electrostatic latent image carrier through an exposure opening formed at the groove such that the exposure light from the exposure device passes through the exposure opening;

a light-shielding member with flexibility, including a first side extending substantially in the main scanning direction and a second side opposite the first side, wherein the first side is fixed to a fixing surface which is a peripheral part of the groove in the housing, such that, in a state where the housing is detached from the image formation apparatus main body, the light-shielding member is in a closing state of closing the groove, and in a state where the housing is attached to the image formation apparatus main body, the light-shielding member is in a retracted state of being bent by the exposure device to position the second side in the groove; and a guide provided at a colliding end portion of the light-shielding member, which first abuts the exposure device when the housing is being attached to the image formation apparatus main body, and the guide being configured to guide the light-shielding member from the closing state to the retracted state when the housing is attached to the image formation apparatus main body, wherein the guide comprises a slope section which goes closer to a bottom of the groove with respect to the surface of the light-shielding member in the closing state, as it goes closer toward the colliding end, and a part of the light-shielding member is fixed to or engaged with a portion of the housing closer to the bottom of the groove than the fixing surface, such that the slope section is formed in the light-shielding member.

2. The image formation unit according to claim 1, wherein the slope section is provided at a position closer to the bottom of the groove than to the first side of the light-shielding member.

3. The image formation unit according to claim 1, wherein a part in proximity to the colliding end and to the first side of the light-shielding member is bent or curved toward the bottom of the groove, such that the slope section is formed in the light-shielding member.

4. The image formation unit according to claim 1, wherein the groove includes an inner surface rising from the bottom toward the fixing surface, and a groove slant formed at a connection part between the fixing surface and the inner surface, and inclined relative to the fixing surface and the inner surface, and wherein a part of the colliding end portion of the light-shielding member is fixed to the groove slant, such that the slope section is formed.

5. The image formation unit according to claim 1, wherein the groove includes an inner wall rising from the bottom toward the fixing surface, and an engagement hole passing through the inner wall, and wherein the light-shielding member includes an arm protruding from the colliding end portion of the light-shielding member, and engaging with the inner wall in a state of the arm being inserted into the engagement hole, such that the slope section is formed.

6. The image formation unit according to claim 5, wherein the arm includes an engagement nail that maintains the state of the arm being inserted into the engagement hole, by engaging with a peripheral part of the engagement hole.

7. The image formation unit according to claim 6, wherein the arm includes the engagement nail at at least one of the first side and the second side in the arm.

8. The image formation unit according to claim 6, wherein the arm changes a depth of insertion into the engagement hole while maintaining the state of being inserted into the engagement hole, according to a force applied to the slope section by the exposure device.

9. The image formation unit according to claim 1, wherein the guide includes, in addition to the slope section, an oblique side that slants relative to a direction orthogonal to an entry direction of the exposure device into the groove, at the colliding end portion in the light-shielding member.

10. The image formation unit according to claim 9, wherein the oblique side slants such that a part closer to a deep side in the entry direction is closer to the second side.

11. The image formation unit according to claim 9, wherein the oblique side is provided in proximity to the second side, at the colliding end portion in the light-shielding member.

12. An image formation apparatus comprising the image formation unit according to claim 1.

13. An image formation unit comprising:

an electrostatic latent image carrier configured to carry thereon an electrostatic latent image to be formed by exposure light from an exposure device;

a housing containing therein the electrostatic latent image carrier in place;

a groove formed at the housing and having an exposure opening, wherein a light emitting section of the exposure device is positioned in the groove in the state where the exposure device is attached to the housing at an usage position where the light emitting section of the exposure device proximately faces the electrostatic latent image carrier such that the exposure light from the exposure device pass through the exposure opening, and wherein the groove extends in an insertion direction of the light emitting section of the exposure device to the groove such that the light emitting section of the exposure device is allowed to be inserted into the groove through an upstream end of the groove in the insertion direction;

a light-shielding member with flexibility, including a first side extending substantially in the insertion direction and a second side opposite the first side, wherein the first side is fixed to a fixing surface which is a peripheral part of the groove in the housing, such that, in a state where the exposure device is detached from the housing, the light-shielding member is in a closing state where the light-shielding member closes the groove, and in a state where the exposure device is attached to the housing at the usage position, the light-shielding member is in a retracted state where the second side of the light-shield member is bent into the groove by the exposure device; and a guide formed at the upstream end portion of the light-shielding member in the insertion direction, and configured to guide the light-shielding member from the closing state to the retracted state when the exposure device is being inserted into the groove of the housing toward the usage position in the insertion direction, wherein the guide comprises a slope section which goes closer to a bottom of the groove with respect to the surface of the light-shielding member in the closing state, as it goes closer toward the upstream end, and a part of the light-shielding member is fixed to or engaged with a portion of the housing closer to the bottom of the groove than the fixing surface, such that the slope section is formed in the light-shielding member.

14. An image formation unit comprising:

an electrostatic latent image carrier configured to carry an electrostatic latent image thereon to be formed by exposure light from an exposure device provided in an image formation apparatus main body;

a housing containing the electrostatic latent image carrier therein, and configured to detachably attach to the image formation apparatus main body in an attachment/detachment direction along a main scanning direction of the exposure device;

a groove formed at the housing extending in the attachment/detachment direction, and configured such that, in a state where the housing is attached to the image formation apparatus main body, a light emitting section of the exposure device is positioned in the groove to proximately face the electrostatic latent image carrier through an exposure opening formed at the groove such that the exposure light from the exposure device passes through the exposure opening;

a light-shielding member with flexibility, including a first side extending substantially in the main scanning direction and a second side opposite the first side, wherein the first side is fixed to a fixing surface which is a peripheral part of the groove in the housing, such that, in a state where the housing is detached from the image formation apparatus main body, the light-shielding member is in a closing state of closing the groove, and in a state where the housing is attached to the image formation apparatus main body, the light-shielding member is in a retracted state of being bent by the exposure device to position the second side in the groove; and a guide provided at a colliding end portion of the light-shielding member, which first abuts the exposure device when the housing is being attached to the image formation apparatus main body, and the guide being configured to guide the light-shielding member from the closing state to the retracted state when the housing is attached to the image formation apparatus main body, wherein the groove includes:

an inner wall rising from the bottom toward the fixing surface, and an engagement hole passing through the inner wall, and the light-shielding member includes an arm protruding from the colliding end portion of the light-shielding member, and engaging with the inner wall in a state of the arm being inserted into the engagement hole, such that the slope section is formed.

15. The image formation unit according to claim 14, wherein the arm includes an engagement nail that maintains the state of the arm being inserted into the engagement hole, by engaging with a peripheral part of the engagement hole.

16. The image formation unit according to claim 15, wherein the arm includes the engagement nail at at least one of the first side and the second side in the arm.

17. The image formation unit according to claim 15, wherein the arm changes a depth of insertion into the engagement hole while maintaining the state of being inserted into the engagement hole, according to a force applied to the slope section by the exposure device.

18. The image formation unit according to claim 14, wherein the first side of the light-shielding member is fixed to the fixing surface at a first side edge of the groove of the housing, such that, in a state where the housing is detached from the image formation apparatus main body, the second side of the light-shielding member substantially reaches a second side edge of the groove which is opposite to the first side edge and thereby the light-shielding member is in a closing state of closing the groove.

19. The image formation unit according to claim 1, wherein the first side of the light-shielding member is fixed to the fixing surface at a first side edge of the groove of the housing, such that, in a state where the housing is detached from the image formation apparatus main body, the second side of the light-shielding member substantially reaches a second side edge of the groove which is opposite to the first side edge and thereby the light-shielding member is in a closing state of closing the groove.

* * * * *